US006179048B1

(12) United States Patent
Shelton et al.

(10) Patent No.: US 6,179,048 B1
(45) Date of Patent: Jan. 30, 2001

(54) HEAT EXCHANGE SYSTEM HAVING SLIDE BUSHING FOR TUBE EXPANSION

(75) Inventors: Jeffrey N. Shelton, Beaumont; Randy O. McWilliams, Orange, both of TX (US)

(73) Assignee: Engineered Carbons, Inc., Port Neches, TX (US)

( * ) Notice: Under 35 U.S.C. 154(b), the term of this patent shall be extended for 0 days.

(21) Appl. No.: 09/143,693

(22) Filed: Aug. 28, 1998

(51) Int. Cl.[7] ..... F28F 19/00
(52) U.S. Cl. ..... 165/134.1; 165/81
(58) Field of Search ..... 165/134.1, 81, 165/82, 140, 159, 158

(56) References Cited

U.S. PATENT DOCUMENTS

| | | | | |
|---|---|---|---|---|
| 1,814,010 | * | 7/1931 | Snow | 165/134.1 |
| 1,978,166 | * | 10/1934 | Meurk | 165/134.1 |
| 2,615,688 | * | 10/1952 | Brumbaugh | 165/134.1 |
| 2,658,728 | * | 11/1953 | Evans, Jr. | 165/134.1 |
| 2,834,581 | * | 5/1958 | Schefels et al. | 165/134.1 |
| 2,904,315 | * | 9/1959 | Pennella | 165/134.1 |
| 2,956,787 | * | 10/1960 | Raub | 165/134.1 |
| 3,185,210 | * | 5/1965 | Kuhne et al. | 165/134.1 |
| 3,907,026 | * | 9/1975 | Mangus | 165/134.1 |
| 3,990,856 | | 11/1976 | Suzuki . | |
| 4,112,060 | | 9/1978 | Fross . | |
| 4,138,062 | | 2/1979 | Graden . | |
| 4,154,464 | | 5/1979 | Stary . | |
| 4,215,741 | | 8/1980 | Averbuch . | |
| 4,295,519 | | 10/1981 | Bellaff . | |
| 4,296,800 | | 10/1981 | Johnson . | |
| 4,302,423 | | 11/1981 | Cheng . | |
| 4,316,876 | | 2/1982 | Johnson et al. . | |
| 4,366,003 | | 12/1982 | Johnson et al. . | |
| 4,370,309 | | 1/1983 | Cheng . | |
| 4,404,178 | | 9/1983 | Johnson et al. . | |
| 4,418,050 | | 11/1983 | Cheng . | |
| 4,737,531 | | 4/1988 | Rogers . | |
| 4,846,894 | | 7/1989 | Glem . | |
| 5,099,575 | | 3/1992 | Colvin et al. . | |
| 5,499,477 | | 3/1996 | Hurkot . | |

OTHER PUBLICATIONS

Donald Q. Kern. *Process Heat Transfer.* McGraw–Hill Book Company. 1990. pp. 127–137.

Christine Flint and Edward Millman, ed.. *Industrial heat exchangers: A basic guide.* Hemisphere Publishing Corporation. 1982. pp. 56, 156–161.

C. P. Natarajan. "*Improvements to High Temperature Airheater*", Carbon Black World 96, Mar. 4–6, 1996, Nice, France.

* cited by examiner

*Primary Examiner*—Ira S. Lazarus
*Assistant Examiner*—Terrell McKinnon
(74) *Attorney, Agent, or Firm*—Baker Botts L.L.P.

(57) ABSTRACT

A tube-and-shell heat exchanger system is disclosed which provides for partial heating of the cooler stream as it flows through a first compartment in the shell and conducting the partially heated stream to the outlet end of a second compartment in the shell to maintain the outlet end of the tubes at a higher temperature. The higher temperature at the outlet ends of the tubes avoids rapid fouling of tubes near the outflow end. There are provided slide bushings for tubes passing between the compartments in the shell. The slide bushings make possible heating of greater volumes of the cooler stream and maintaining the outlet end of tubes at higher temperature, while extracting more heat from the hot stream. The slide bushings provided may also be used to replace conventional expansion joints. The system is particularly useful in carbon black plants, where the hot smoke stream containing combustion gases and carbon black is used to preheat the air stream used for burning fuel in the reactor of the plant.

29 Claims, 3 Drawing Sheets

FIG. 1
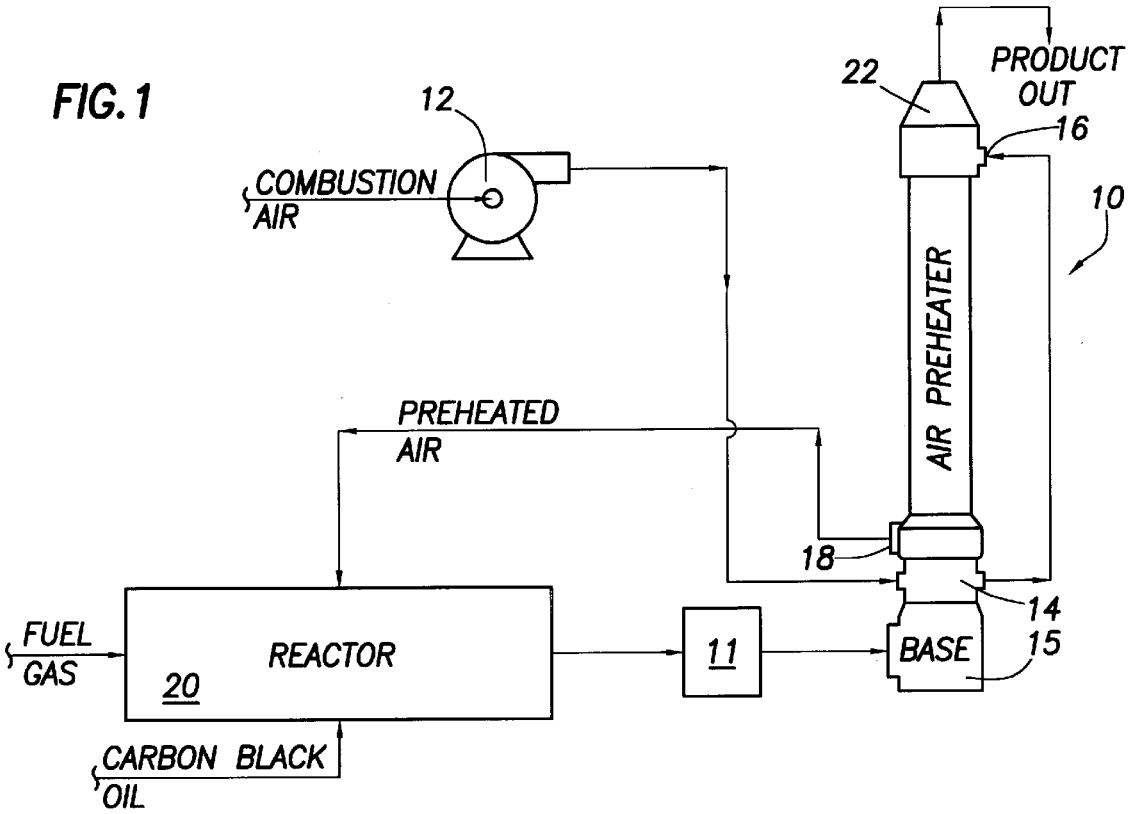
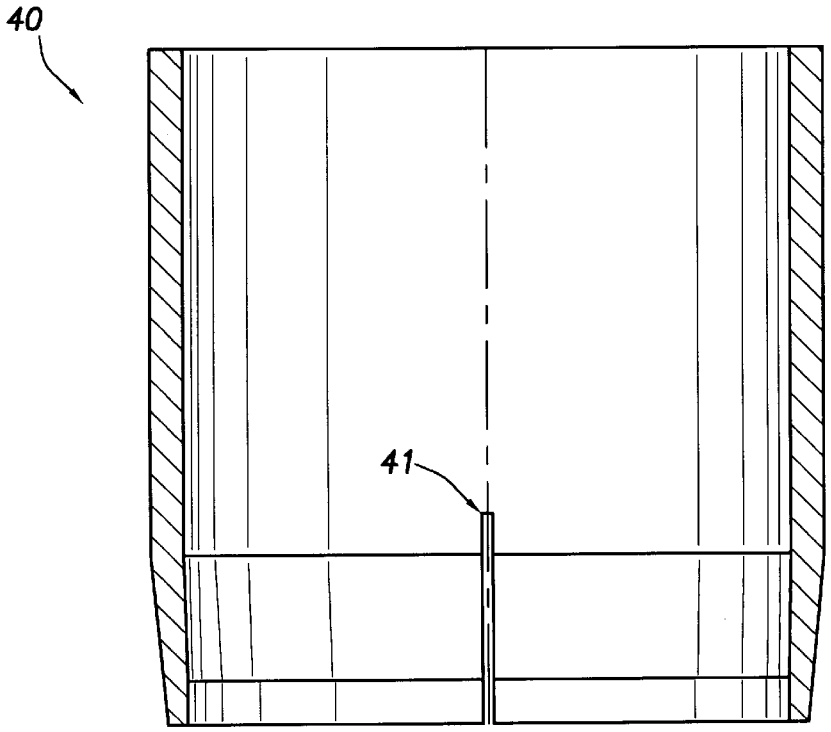
FIG. 3

FIG.4
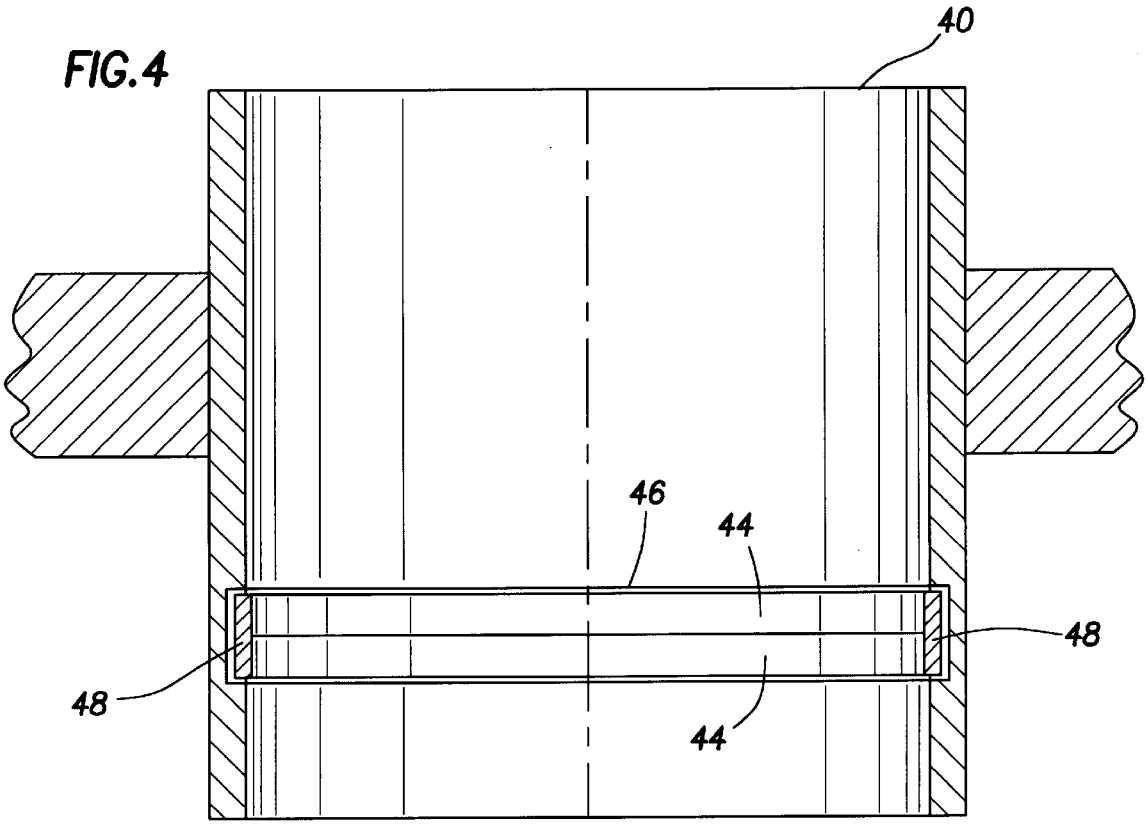
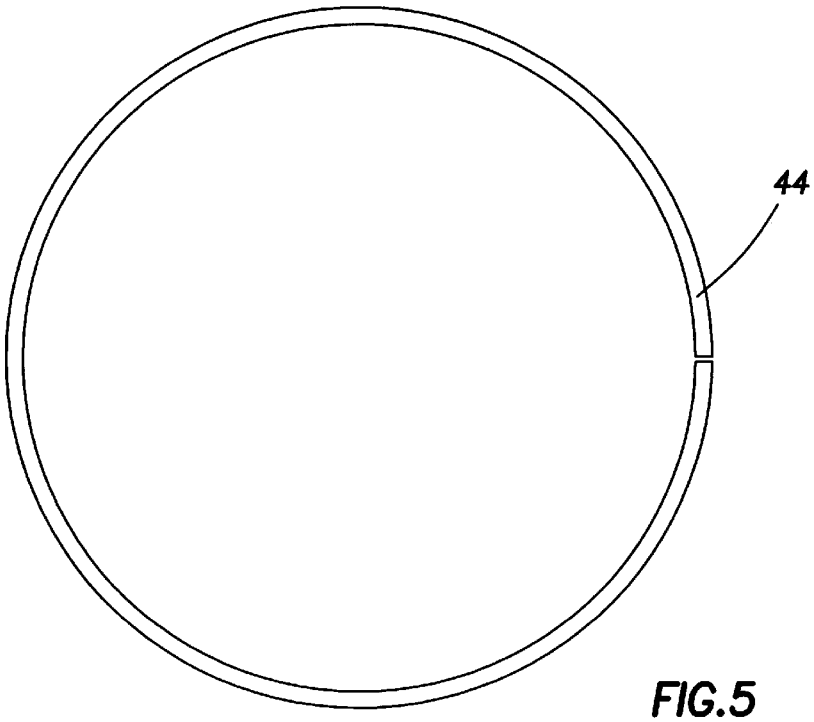
FIG.5

HEAT EXCHANGE SYSTEM HAVING SLIDE BUSHING FOR TUBE EXPANSION

BACKGROUND OF THE INVENTION

1. Field of the Invention

This invention relates to high-temperature heat exchangers for gas streams. More specifically, improved apparatus and method for recovering heat from the furnace effluents stream in a carbon black plant to preheat the combustion air stream are provided.

2. Description of Related Art

In the typical carbon black production process, fuel and air are combusted in a furnace to provide the necessary temperature and energy for the carbon black production step. Oil feedstock is injected directly into the combustion gases, still inside the furnace, where the feedstock is dehydrogenated in a pyrolytic reaction to form carbon black and other gaseous products. The final stream, after all the reactions are complete, is referred to as "smoke." In order to completely stop all the reactions and to cool the furnace effluent, the smoke is quenched by direct contact with water. After the water quench, the smoke stream is still very hot and can be used to heat other process streams, such as the combustion air stream.

Preheating the combustion air stream significantly increases efficiency of the carbon black production process by reducing the amount of fuel required while also increasing the capacity of a carbon black production unit. Various processes and apparatuses for preheating the combustion air stream in a carbon black production process are known to the industry. Most carbon black production processes use a vertical shell-and-tube heat exchanger to preheat the combustion air stream by indirect contact with the smoke stream exiting the water quench. The smoke stream typically flows upwards through the tubes while the air stream is forced downward through the shell. Combustion air exiting the current industry standard air preheater may be heated to temperatures up to about 800° C.

Several problems must be considered when designing a preheater for carbon black production. First is the tendency of the smoke stream to deposit carbon particles inside the tubes, thus fouling those surfaces and reducing heat exchange efficiency. If the smoke stream is cooled too much, the fouling becomes particularly pronounced. Thus, most preheating processes and apparatuses are designed to keep the smoke stream hot in order to reduce fouling as much as possible.

Several remedies exist in current practice to maintain the smoke streams at high temperatures and prevent fouling. First, a sheath may be constructed around the top portion of the tubes, thus creating a stagnant air gap between the sheath and the tube surface. The air gap reduces heat exchange in the area of the sheath and thus reduces cooling of the smoke stream. Unfortunately, the amount of heat transferred to the combustion air is also reduced, resulting in a less efficient preheater. Furthermore, the sheathing complicates the heat exchanger manufacturing process and adds to exchanger cost.

A second remedy is to decrease flow of combustion air through the preheater. U.S. Pat. No. 4,737,531 discloses a method by which a control valve causes a fraction of combustion air to bypass the preheater. A lower flow of combustion air through the preheater transfers less heat away from the smoke stream, keeping the smoke at a temperature higher than the temperature at which high rates of fouling occur. This method requires a complicated and costly control system and preheats only a portion of the combustion air.

A third design uses a double tubesheet (two parallel, closely spaced, tubesheets) in a heat exchanger and two stages of air compression ("Improvements to High Temperature Airheater," presented at Carbon Black World 96, Nice, France, Mar. 4–6, 1996). Hot gas from a reactor, carrying carbon black smoke, is passed through the tubes of a shell-and-tube heat exchanger. The double tubesheet in the shell around the inflow end of the tubes creates two separate heat exchange compartments on the shell side. Compressed air is fed to the air pre-heater from a first compression stage. About 20% of the air stream from the first compression stage is diverted to a second compression stage and forced between the double tubesheets, which form a small compartment on the shell side of the exchanger. Air flows radially inward across the tubes between the double tubesheets and is then directed up a center tube in the shell to the top of the heat exchanger. The preheated air then encounters a baffle system at the top of the heat exchanger where it mixes with compressed unheated air from the first stage of compression. The combined stream then flows through the shell side countercurrent to flow of the smoke stream in the tubes.

The slip stream that is further compressed and sent to the top of the tubes serves to increase temperature of the top of the tubes, which reduces fouling in the top section of the tubes, but shielding of the top section of the tubes is still normally required to prevent fouling. Shielding of the tubes, which decreases heating of the incoming air, causes loss of efficiency of the pre-heating process, as discussed above.

The double tubesheet at the end where the hot smoke stream enters the pre-heater addresses another problem of combustion air preheaters—mechanical failure of the tubes and the tubesheet caused by high temperature of the smoke stream. Cool air transfers heat away from the tubes and tubesheets in the entry zone and reduces thermal stress on the heat exchanger. Without the double tubesheet, lower temperature of the incoming stream and insulation in the tubes to decrease heat transfer rate are necessary, both of which cause loss of efficiency.

One additional drawback of the third design is a limitation of the volume available between the double tubesheets, and thus a limitation of the temperature that can be attained in the air stream that is to be directed into the shell at the outflow end of the tubes. The heat exchanger tubes are welded to a sleeve which is welded to the middle tubesheet and lower tubesheet, and the tubesheets are welded to the shell in this design. This results in the elimination of air leakage from across the center tubesheet, but it causes other problems. The tubes expand during operation due to their increased temperature. This expansion places stress on the sleeves and tubesheets, and the stress may cause failure, especially at the point where the sleeves are welded to the tubesheet. The greater the distance between the tubesheets, the more stress is created. Limitations in the amount of stress that the tubesheets can tolerate restrict the distance between the tubesheets in the prior art design. Thus, the maximum volume between the double tubesheets and the maximum flow through that compartment of the shell is restricted.

While the third design makes improvements in the operation of air preheaters for use in carbon black plants, increased complexity in design of the heat exchanger and increased cost of a second compression step are necessary. Shielding of the top of the tubes may still decrease efficiency.

All of the above mentioned high temperature air preheater designs utilize expansion joints which are welded to the upper tubesheet. Commercially available expansion joints have a significantly larger diameter than the tubes, and thus allow for little tubesheet material between tubes in the upper tubesheet. Also, the expansion joints put extra stress on the bottom and top tubesheets. The combination of little top tubesheet material and stress often causes tubesheet failure. Further, the commercially available expansion joints themselves are often prone to fail.

What is needed is a heat exchanger system that has reduced complexity and cost while retaining and improving efficiency of the heat recovery process and increasing service life of the system.

SUMMARY OF THE INVENTION

A slide bushing inserted in the middle tubesheet of a tube-and-shell heat exchanger allows for tube expansion during heat exchange with very hot gas passing through the tubes and restricts flow between the tubes and tubesheet. A slide bushing mechanism may also be used in place of an expansion joint to seal between tube and the terminal tubesheet, in which case the slide bushing contains rings and is designed to allow very small leakage across the tubesheet.

Apparatus and method are provided for pre-heating an air stream by heat exchange with the hot smoke stream in a carbon black producing unit. Three tubesheets separate the shell side of the heat exchanger into two compartments. Slide bushings allow thermal expansion of the tubes through the middle tubesheet. The entire combustion air stream is compressed and passed through the compartment of the shell between the first and second tubesheets at the inflow end of the tubes where it is heated, then passed through an insulated conduit outside the shell and back into the shell at the outflow end of the tubes. The air stream is heated sufficiently in the first compartment to minimize fouling of the tubes at the outflow end. Leakage through the slide bushings from the first compartment to the second compartment may be allowed to provide cooling to the tube and sleeves. The air stream then passes through the shell countercurrent to flow in the tubes and to an exit manifold near the middle tubesheet.

The slide bushing is welded or otherwise joined to the middle tube sheet and is designed to closely fit around the tubes. The slide bushing may be designed for metal to metal contact at operating temperature and may include a slit to reduce frictional force between the bushing and the tube. Alternatively, the slide bushing may have ring grooves which hold one to several rings in place. The rings may be ceramic. Ceramic paper, well known in industry, may be placed between the slide bushings and the ceramic rings to decrease leakage around the rings.

Further features and advantages of the invention will be understood from the following detailed description of preferred embodiments with reference to the attached drawings.

BRIEF DESCRIPTION OF THE DRAWINGS

FIG. 1 is a flow diagram of a carbon black production unit using the present invention.

FIG. 3 depicts a first embodiment of a slide bushing of the present invention.

FIG. 4 depicts a second embodiment of a slide bushing having ring grooves.

FIG. 5 depicts an embodiment of a seal ring for use in a slide bushing.

DESCRIPTION OF THE PREFERRED EMBODIMENTS

Figure 2:
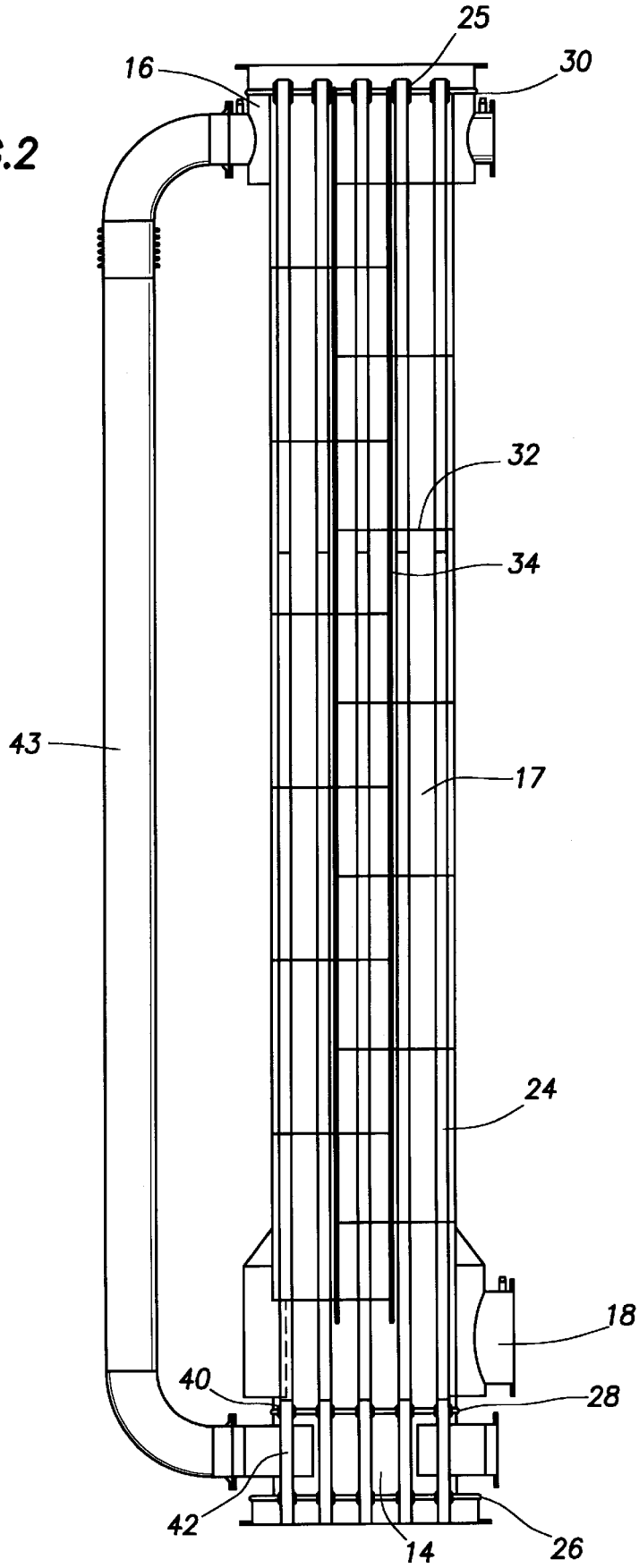
FIG. 2 is a drawing of the inside of the shell of the heat exchanger of the present invention.

Referring to FIG. 1, air preheater system 10 is shown. Air is compressed in compressor 12 and sent to compartment 14 where it is heated by gases from reactor 20 which have been directed through base 15 and into the tubes of a tube-and-shell heat exchanger. Base 15 is shown at the bottom of a vertical heat exchanger, but may alternatively be placed at the top of a vertical apparatus or at either end of a horizontal apparatus. For ease of description, the use of the terms "top", "bottom" and "middle" will be used herein. In any case, base 15 is located at the end of the heat exchanger where a hot process stream enters the tubes. The volume of air compressed by compressor 12 is preferably equal to the combustion requirements in reactor 20. Outlet pressure at compressor 12 depends on flow resistance in air preheater 10, but will usually be in the range from about 6 psig (41 gage kilopascals) to about 12 psig (82 gage kilopascals).

After compressed air is heated in compartment 14 to an elevated temperature, often in the range of 150 to 200° C., it is passed through an insulated conduit outside the heat exchanger to top inlet manifold 16, where it enters the shell side of the heat exchanger and flows countercurrent to gas flowing inside the tubes and exits at air exit manifold 18. From air preheater 10 the air is piped to reactor 20. The stream containing the carbon black from reactor 20 exits the tubes in the air preheater into bonnet 22 and goes to a bag house or other equipment for separating and pelletizing the carbon black.

FIG. 2 shows the arrangement inside the shell of air preheater 10 with base 15 and bonnet 22 removed. Tubes 24 contain the hot gas carrying carbon black. First or bottom tubesheet 26 and second or middle tubesheet 28 form first compartment 14 in the shell side of the heat exchanger. The air stream within this compartment is directed across the entire tube bundle. Second tubesheet 28 and third or top tubesheet 30 form second compartment 17. Baffles 32 and baffle supports 34 improve efficiency of heat transfer from hot gas in tubes 24 to combustion air passing countercurrent in main compartment 17 before exiting through lower manifold 18.

Tubes 24 are rigidly attached and sealed to tubesheet 26, using techniques well known in industry. Expansion joints well known in the industry (not shown) or terminal slide bushings 25 of the present invention may be used to provide a seal between the outflow end of tubes 24 and tubesheet 30. In the apparatus and method of this invention, tubes 24 preferably pass through middle tubesheet 28 within slide bushings 40. Slide bushings 40 are designed to control leakage of air through second tubesheet 28 and allow for thermal expansion of the tubes. The slide bushings prevent high thermal stresses in the tubes and tubesheets that are present when tubes are fixed to the second tubesheet, as in prior art designs. Velocity stack inserts 42 are also depicted in FIG. 2. As known in the art, they serve to protect tubes 24 from the hot turbulent gases near the inflow end of the tubes and can be replaced when necessary.

FIG. 3 shows a detailed view of one embodiment of slide bushing 40. Slide bushing 40 is designed for a metal to metal contact between tube 24 and slide bushing 40 at operating temperatures. Slit 41 reduces frictional force between slide bushing 40 and tube 24 after thermal expansion in the diameter of tube 24. Some air leakage is allowed from compartment 14 to compartment 17. The difference between the outer diameter of the slide bushing 40 and the inner diameter of the tube 24 can be from about 0.005 inch (0.013 cm) to about 0.02 inch (0.051 cm) at room temperature, but is selected to prevent leakage of not more than about 15 percent of the air rate entering compartment 14. A selected amount of leakage may be desirable to provide cooling for the tubesheet and tube.

FIG. 4 depicts a second embodiment of slide bushing 40. In this design, at least one bushing ring groove 46 is cut into slide bushing 40. FIG. 5 depicts seal ring 44 which fits into this groove 46. The split at the seal ring 44 may be at any angle but in a preferred embodiment is perpendicular to a line tangent to the ring. The seal ring system of FIG. 4 and FIG. 5 can be used to control air leakage rate to less than 1 percent of inflow rate into the shell side of the heat exchanger, if desired. The number of rings 44 fit in a bushing ring groove 46 may vary from one to ten. In a preferred embodiment two rings 44 are utilized for slide bushing 40, and the rings are aligned so that the splits in the rings are opposed 180°. Rings are selected to seal between the outside diameter of tubes and tube rings 44. Ceramic paper 48, well known in the industry, may be placed between the bushing ring groove 46 and seal rings 44 to further reduce leakage. Suitable ceramic rings are available from Kyocera of Elk Grove Village, Ill.

At low rates of air leakage through slide bushing 40, the air may be heated to about 500 ° C. The leaking air then mixes with the hot air in main compartment 17 of FIG. 2. Since the leaking air is such a small volume stream, and since it is heated while leaking, the air preheater loses very little heat exchange efficiency due to the leakage. Further, some leakage of the air is desired to cool the tubes as they pass through the middle tubesheet.

The air which does not pass through second tubesheet 28 depicted in FIG. 2 exits compartment 14 at a temperature preferably of about 175° C. or more. The preheated air passes through insulated conduit 43 and enters compartment 17 through upper inlet manifold 16. Mechanical shielding of the top of the tubes to prevent fouling inside the tubes is normally not needed because the air temperature entering manifold 16 is higher than in prior art apparatus.

Air exiting the exchanger at exit manifold 18 is at a temperature higher than the air exiting preheaters in the prior art that are operating at the same rate of production and with the same feed streams, because of the improved efficiency of heat transfer in the heat exchanger. The higher temperature preheated air is used to burn a fuel (normally natural gas) and the higher temperature combustion stream is more effective in pyrolyzing carbon black oil which is fed to the reactor. The result is lower fuel requirement and lower costs of production and increased unit capacity. This mixture of gaseous products and carbon black is quenched with water in water quench section 11, shown in FIG. 1. The quench is used to stop the reactions.

The smoke stream exits the reactor 20, depicted in FIG. 1, at temperatures as high as approximately 1650° C. The smoke my exit the water quench section 11 at approximately 1000 ° C. The quenched smoke stream is then directed to the air preheater. Since the preheater operates at higher inlet temperatures than inlet temperatures of prior art preheaters, less water is required in the quench process, allowing more heat to be recovered in the preheater. The slide bushing design of this invention will make possible higher inlet temperatures at the preheater, greater efficiency of heat transfer from the hot inlet gas and longer lifetime of the heat exchanger equipment.

The exchanger may utilize a commercially available expansion joint at the top of each tube. Referring again to FIG. 2, expansion joints (not shown) may be welded between the tubes and third tubesheet 30 to allow for thermal expansion in length of the tubes between tubesheet 28 and tubesheet 30, as is well known in the art. Alternatively, according to the present invention, the exchanger will utilize terminal slide bushings 25 fixed in third tubesheet 30. Terminal slide bushings 25 preferably have the design depicted in FIG. 4, so as to allow only very small leakage rates. Bushing ring groove 46 of the terminal slide bushing may be designed to hold one to ten seal rings 44, but in a preferred embodiment, two to five seal rings are utilized. The rings are preferably positioned so that splits in neighboring rings are angularly displaced so as to maximize resistance to flow though the splits of successive rings. Groove 46 is sized to minimize the gap between rings 44 and the groove 46 at operating conditions so as to maximize resistance to flow along the surfaces between rings. Ceramic paper 48, well known in the art may be utilized between the rings 44 and ring groove 46 to decrease leakage between the rings and the groove. Terminal slide bushings 25 having the features shown in FIG. 4 allow very low rates of leakage of gas through tubesheet 30 of FIG. 2.

A variety of materials can be used in the apparatus of this invention. In a preferred embodiment, the half of tubes nearest base 15 and velocity stack inserts 42 are made of 310 stainless steel that has undergone an aluminum co-diffusion process on the interior surfaces. The process is available from Alon Surface Technologies of Tarentum, Pa. The aluminum co-diffusion process offers excellent resistance to oxidation and sulfidation at the higher temperatures. The tubesheets, slide bushings, lower shell, baffle plates, and upper tubes may be made from 304H stainless steel. Carbon steel 516-70 is preferably used for a portion of the upper shell and lifting lugs. Commercially available expansion joints, if utilized, are preferably made of INCONEL alloy. Other choices of materials may be suitable in other embodiments, depending on operating temperatures.

The slide bushings allow thermal expansion of tubes in the first compartment, which makes possible extension of this compartment over a greater length so that all of the combustion air stream can be directed through this compartment. Further, the additional cooling near the inflow end of the tubes reduces the need for insulation between the velocity stack and the tube in the double tubesheet area and further decreases cost and enhances exchanger efficiency. The distance between the two tubesheets near the inflow end of the tubes is selected to optimize temperature of the air stream exiting this first compartment. The distance is preferably selected to prevent rapid fouling of tubes near the outlet end of the tubes. The distance between the first and second tubesheets may vary from about one-quarter to one-and-a-half times the inner diameter of the exchanger shell. For example, in one carbon black plant, the shell inside diameter is about 49 inches (124 cm) and the distances between the two tubesheets is designed to be about 22 inches (56 cm), or 0.45 times the diameter. The specific distance ratio of tubesheets to shell inner diameter should also be chosen to provide adequate cooling of the first and second tubesheets.

Directing the entire combustion air stream through the first compartment offers many advantages. First, since the combustion air stream follows only one path, only one compression step is needed and no control system is needed, thus eliminating costly parts of previous designs. Since the entire combustion air stream is heated in the first compartment, the temperature of the combustion air stream entering the shell around the outlet end of the tubes is substantially hotter than in previous designs. The hotter combustion air stream reduces fouling in the tubes without using tube shielding. Elimination of the tube shielding makes the entire heat exchanger more efficient and less costly to build than a comparable heat exchanger with shielding. Another advantage is that a higher air flow through the non-insulated first compartment more easily transfers heat away from the tubes and the velocity stack inserts. Cooler velocity stack inserts will last longer, and this will reduce heat exchanger maintenance costs.

Use of terminal slide bushings in the top tubesheet eliminates many of the problems faced by currently available expansion joints. The terminal slide bushings put less stress on the tubesheets and also have smaller diameter than the current expansion joints, allowing more tubesheet material between tubes. Additional tubesheet material and reduced stress reduces the likelihood of tubesheet failure and increases exchanger service life. Also, the terminal slide bushings themselves are less likely to fail than currently available expansion joints. The inventive terminal bushings further add to the service life of the exchanger.

While the pre-heater of this invention has been discussed especially with respect to its application in the carbon black industry, it should be understood that the apparatus and methods of this invention can be applied to any tube-and-shell heat exchanger where excess cooling of tubes near the outflow end is to be avoided or where excessive thermal stresses may occur within the tubes or tubesheets of the heat exchanger. Either the process stream through the tubes or through the shell of the heat exchanger may be gaseous or liquid or a combination thereof, but they will normally be gaseous. The deposit causing fouling can be suspended solids or solids precipitated upon cooling.

It should also be understood that some of the characteristics achieved by the "bushing" described herein can be achieved by selected procedures in forming a tubesheet. Such a tubesheet would be equivalent to a tubesheet adapted to receive the bushings and the bushings sealingly attached therein. For example, holes in a tubesheet can be drilled to diameters having a selected diameter greater than the tube diameters, a groove can be cut in the hole and a ring or a plurality of rings can be placed in the groove. Alternatively, a plurality of grooves can be cut in each hole of the tubesheet.

Although the present invention has been described in connection with preferred embodiments, the invention is not limited thereto. The embodiments and features disclosed herein are provided by way of example only. It will be easily understood by those of ordinary skill in the art that variations and modifications can be easily made within the scope of this invention as defined by the following claims.

What we claim is:

1. A heat exchanger system including a plurality of tubes disposed within a shell, the shell having an inner diameter, comprising:

means for directing a hot fluid stream into the tubes, the tubes having an inflow end and an outflow end;

a first, second and third tubesheet sealingly attached to the shell, the first and third tubesheet being disposed in proximity to the inflow end and the outflow end of the tubes, the second tubesheet being disposed therebetween and having means for sliding of the tubes therethrough while providing for leakage and restricting flow between the tubes and the second tubesheet; and means for directing a cooler fluid stream into a first compartment in the shell, the first compartment being between the first and second tubesheet and having a volume, then out of the first compartment to a distal end of a second compartment in the shell, the second compartment being between the second and third tubesheet, wherein the cool fluid stream can flow countercurrent to the hot fluid stream in the tubes to an outlet from the second compartment in proximity to the second tubesheet.

2. The system of claim 1 wherein the means for sliding of tubes through the second tubesheet while restricting flow is a plurality of bushings, each bushing being between one of the plurality of tubes and the second tubesheet, the bushings being sealingly attached to the tubesheet and sized to limit flow through the tubesheet to less than 15 percent of the cooler fluid stream.

3. The system of claim 2 wherein each bushing further contains a slit adapted to reduce frictional force between the bushing and the tube after thermal expansion in diameter of the tube.

4. The system of claim 2 wherein each bushing further contains a groove, the groove having a bottom surface, and one or a plurality of sealing rings therein, each sealing ring being adapted to increase resistance to fluid flow through the bushing.

5. The system of claim 4 wherein each sealing ring of the plurality of rings further comprises a split and the rings are disposed so that the splits on proximate rings are angularly displaced.

6. The system of claim 4 further comprising a strip of ceramic paper between the bottom surface of the groove and the sealing ring or rings.

7. The system of claim 1 wherein the distance between the first and second tubesheet is in the range from about 0.25 to about 1.5 times the inner diameter of the shell.

8. The system of claim 1 wherein the distance between the first and second tubesheet is in the range from about 0.4 to about 1.5 times the inner diameter of the shell.

9. The system of claim 1 wherein the volume of the first compartment is selected so that the cooler fluid stream adequately transfers heat to prevent fouling near the outflow ends of the tubes and provides adequate cooling to the first and second tubesheets so as to increase lifetime of the tubesheets.

10. The system of claim 1 wherein the tubes are made of stainless steel in a portion of the inflow end and an interior surface of that portion of the tube is coated using an aluminum diffusion process.

11. A method for preheating an air stream and burning fuel to form carbon black, comprising the steps of:

directing the air stream to an air preheater, the preheater having a plurality of tubes and a first, second and third tubesheet disposed in a shell, the shell having an inside diameter;

means for directing a hot fluid stream from a reactor for forming the carbon black into the tubes, the tubes having an inflow end and an outflow end, the first, second and third tubesheet being sealingly attached to the shell, the first and third tubesheet being disposed in proximity to the inflow end and the outflow end of the tubes, respectively, the second tubesheet being disposed therebetween and having means for sliding of the tubes therethrough while providing for leakage and restricting flow between the tubes and the second tubesheet, means for directing the air stream into a first compartment in the shell, the first compartment being between the first and second tubesheet and having a volume, then out of the first compartment to a distal end of a second compartment in the shell, the second compartment being between the second and third tubesheet, wherein the air stream can flow countercurrent to the hot fluid stream in the tubes to an outlet from the second compartment in proximity to the second tubesheet; and conducting the air stream from the preheater to the reactor for forming the carbon black.

12. The method of claim 11 further comprising the step of placing bushings in the second tubesheet to restrict flow between the first and second compartment, the bushings being sealingly attached to the tubesheet and sized to limit flow through the tubesheet to less than 15 percent of the air stream.

13. The method of claim 12 further comprising the step of forming a slit in each bushing before the bushings is placed in the tubesheet to reduce frictional force between the bushing and tube after thermal expansion in diameter of the tube.

14. The method of claim 11 further comprising the step of forming a groove in each bushing and placing a ring in the groove before the bushing is placed in the tubesheet.

15. The method of claim 14 further comprising the step of placing a strip of ceramic paper in the groove before the sealing ring.

16. The method of claim 11 wherein the first and second tubesheets are disposed in the shell at a lateral distance apart in the range from about 0.25 to about 1.5 times the inner diameter of the shell.

17. The method of claim 11 wherein the volume of the first compartment is selected so that the air stream adequately transfers heat to prevent fouling near the outflow ends of the tubes and provides adequate cooling to the first and second tubesheets.

18. The method of claim 11 further comprising the step of coating a portion of the tubes from the inflow end using an aluminum diffusion process.

19. A heat exchanger having a plurality of tubes disposed in a shell, comprising:

means for directing a first fluid steam into the tubes, the tubes having an inflow end and an outflow end and an interior surface, and means for directing a second fluid flowing at a selected flow rate through the shell;

a plurality of tubesheets sealingly attached to the shell, at least one of the tubesheets being sealingly attached to the tubes; and a plurality of bushings in at least one of the tubesheets, the bushings being adapted for sliding of the tubes therethrough while providing for leakage and restricting flow between the tubes and the tubesheet to a selected percentage of the selected flow rate through the shell.

20. The heat exchanger of claim 19 wherein each of the bushings further comprises a slit to reduce frictional force between the bushing and the tube.

21. The heat exchanger of claim 19 wherein each of the bushings further comprises a groove and a sealing ring therein, the ring being selected to obstruct flow through the bushing.

22. The heat exchanger of claim 21 further comprising a strip of ceramic paper between the groove and the sealing ring.

23. The heat exchanger of claim 19 wherein the plurality of tubesheets consists of a first, second and third tubesheet, the tubes are sealingly attached to the first tubesheet and the third tubesheet and the bushings are disposed in the second tubesheet.

24. The heat exchanger of claim 19 wherein the plurality of tubesheets consists of a first, second and third tubesheet, the tubes are sealingly attached to the first tubesheet and the bushings are disposed in the second and third tubesheet.

25. A tubesheet for a heat exchanger, the heat exchanger having tubes disposed in a shell, comprising:

a plate having holes therein and being adapted for sealing in the shell, and a plurality of bushings sealingly attached in the holes in the plate, each bushing being adapted to allow a tube to slide therethrough while providing for leakage and restricting fluid flow therethrough to a selected value.

26. The tubesheet of claim 25 wherein each bushing further contains a slit adapted to reduce frictional force between the bushing and the tube after thermal expansion in diameter of the tube.

27. The tubesheet of claim 25 wherein each bushing further contains a groove, the groove having a bottom surface, and one or a plurality of sealing rings therein, each sealing ring being adapted to increase resistance to fluid flow through the bushing.

28. The tubesheet of claim 27 wherein each sealing ring of the plurality of rings further comprises a split and the rings are disposed so that the splits on proximate rings are angularly displaced.

29. The tubesheet of claim 27 further comprising a strip of ceramic paper between the bottom surface of the groove and the sealing ring or rings.

* * * * *